United States Patent [19]

Craighead et al.

[11] 4,344,816

[45] Aug. 17, 1982

[54] SELECTIVELY ETCHED BODIES

[75] Inventors: Harold G. Craighead, Fair Haven; Richard E. Howard, Holmdel; Donald M. Tennant, Freehold, all of N.J.

[73] Assignee: Bell Telephone Laboratories, Incorporated, Murray Hill, N.J.

[21] Appl. No.: 218,089

[22] Filed: Dec. 19, 1980

[51] Int. Cl.[3] ..... C23F 1/02

[52] U.S. Cl. ..... 156/643; 156/646; 156/656; 156/657; 156/659.1; 156/644; 204/192 E; 252/477 R; 428/929; 428/606

[58] Field of Search ..... 156/643, 646, 653, 656, 156/657, 659.1, 662; 252/79.1; 204/164, 192 EC, 192 E, 298

[56] References Cited

U.S. PATENT DOCUMENTS 3,971,684 7/1976 Muto ..... 204/192 E
4,203,800 5/1980 Kitcher ..... 156/643
4,226,665 10/1980 Mogab ..... 156/643
4,284,689 8/1981 Craighead et al. ..... 428/620

*Primary Examiner*—William A. Powell
*Attorney, Agent, or Firm*—Bruce S. Schneider

[57] ABSTRACT

Bodies having conical structures with dimensions on the order of the wavelength of visible light are prepared by a specific process. This process involves the formation of a mask by depositing a material that forms the mask onto the body to be etched and choosing the mask material so that it does not substantially wet the surface of the body. The mask thus fabricated has hill-type formations where the spacings between these formations are of the order of the wavelength of visible light. An etchant that etches the mask at a specific rate relative to the underlying body is then used to perform the etching procedure. Exemplary bodies produced by the procedure include tungsten textured bodies that exhibit light emissivities significantly higher than those possessed by the corresponding untreated tungsten material.

12 Claims, 1 Drawing Figure

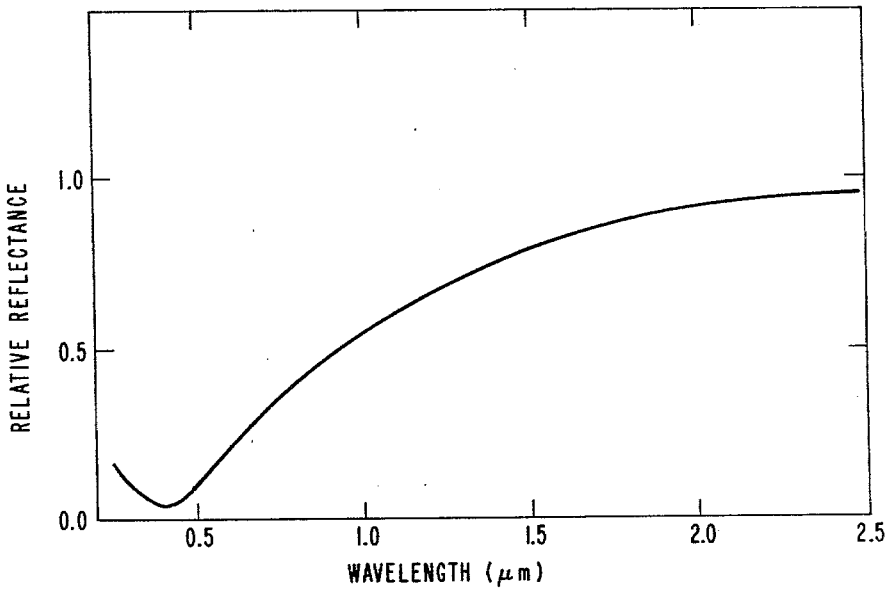
RELATIVE REFLECTANCE
1.0
0.5
0.0
0.5
1.0
1.5
2.0
2.5
WAVELENGTH (μm)

SELECTIVELY ETCHED BODIES

BACKGROUND OF THE INVENTION

1. Field of the Invention

This invention relates to etching and, more particularly, anisotropic etching.

2. Art Background

The efficacy of a material for a particular application is often more strongly dependent on the internal geometric structure of the material than its composition. For example, the usefulness of a porous media, i.e., a body having channels or a reticulated structure, as a chemical catalyst strongly depends on the configuration of the channels or reticulations. The larger the surface area provided by a given channel or reticulation configuration generally the more efficient the catalyst.

Optical properties are also significantly affected by the internal configuration. In particular, porous bodies such as dendritic tungsten having needle-like structures with dimensions of or greater than 2 μm have been employed as solar absorbers. These needle-like structures, with spacings much greater than the wavelength of visible light induce multiple reflection of light entering the area between the needles. On each reflection some absorption of light occurs and, through repeated reflections, a significant amount of light is ultimately absorbed. This enhanced absorption naturally leads to enhanced efficiency in the use of solar radiation.

Although structures such as porous bodies derive many of their attributes from their internal geometry, for some applications it has been desirable to severely limit the extent of this internal geometry. For example, electron emitters used in producing columnated electron beams for applications such as the exposure of resist materials during semiconductor device fabrication are structures that, in fact, benefit from a limited, indeed a non-existent, internal geometry. Typically, a single crystal material with a low work function, i.e., a material with a thermionic work function less than 5 eV, is formed so that it comes to a single sharp point. When an electric potential is applied, the electric field is extremely intense at this point and electron emission occurs primarily from the area of strongest field. In this manner, a relatively intense electron beam is produced.

In all the previously described situations and in a multitude of other applications, control of internal geometry is extremely important. As discussed, internal configuration is particularly significant for important applications such as those involving catalysis, optical devices, and energy transfer. Obviously, the development of methods for controlling internal structures to produce a desired configuration, and thus a desired result, is significant.

SUMMARY OF THE INVENTION

The application of a specific process leads to the production of bodies having a multiplicity of closely spaced conical structures. The body to be fabricated into the desired structure is contacted by a mask material that does not substantially wet it. The mask material does not form a continuous layer, but instead forms a plurality of hill-like structures. The spacings among these hill-like structures are controlled so that they are on the order of the wavelength of visible light. The hilly structures are then used as a mask for etching the underlying etchable material. During the etching process not only is a portion of the etchable material removed, but also the extremities of the hills are eroded. By controlling the rate of etching of the mask relative to the rate of etching of the underlying body a series of conical shapes are produced that yield advantageous properties for the treated body.

For example, when tungsten is treated by the inventive procedure, a visible light emissivity is achieved that is approximately double that of a corresponding untreated tungsten material. Thus, the light emission of a tungsten body is enhanced twofold. This result has quite significant ramifications for incandescent light production. Since tungsten is refractory and has shown electron emission and, since the conical shapes present a plurality of points, this structure is also useful for the production of electron fluxes. Finally, the surface area of structures formed by the subject treatment has been significantly increased and thus the possibility for enhancing catalytic activity is also produced. Thus, the subject process and the resulting products lead to extremely important benefits.

BRIEF DESCRIPTION OF THE DRAWING

The FIGURE illustrates properties achievable in bodies etched by the inventive process.

DETAILED DESCRIPTION

The material to be patterned is either a body composed of a single material or is a base material having an overlying layer or layers. The body is directly etched in the former case, or in the latter case, the overlying layer(s) are etched and, if desired, the etch is continued through the layer(s) into the underlying material. (For convenience, the body to be etched with all its layers will be referred to as the substrate.) The etching is done by utilizing anisotropic etching, i.e., an etchant that etches in a direction normal to the substrate at a rate twice as great as it etches parallel to the substrate. In a preferred embodiment reactive ion etching is utilized. (See H. Lehmann and R. Widmer, *Journal of Vacuum Science and Technology,* 15, 319 (1978), for a general description of reactive ion etching.) The particular etchant utilized for a given substrate material generally varies. However, a suitable etchant for a variety of desirable substrate materials is known. (See, for example, Lehmann supra for a compendium of suitable etchants for a given material.) For example, $CF_4$ and $CF_3Br$ are useful for silicon, $CF_4$ and $CF_3Br$ are useful for metals such as tungsten and molybdenum, $CCl_4$ for aluminum, $CHF_3$ for silicon oxide and $O_2$ is useful for most organic material.

Before the etching procedure is initiated a mask is formed on the substrate. This mask is made by depositing a material onto the substrate that does not substantially wet it. Some minimal wetting interaction between the masking material and substrate is required to insure adhesion of the mask. Wetting, however, should be sufficiently small so that the mask material forms curved hillocks rather than a continuous film. In determining what material is useful for a given substrate, it is expedient to use the results from phase diagrams. The phase diagrams are determined at different temperatures for the combination of bulk mixing of the mask material with the material forming the surface of the substrate that is etched. If a third phase other than a simple solution in addition to that of the mask and the substrate material is spontaneously formed at temperatures utilized in the deposition of the mask, the particular combination is in general not useful. Thus, through this method appropriate materials for mask formation on a given substrate are identifiable. Although most materials which pass this criterion are appropriate, in a few instances surface effects sometimes limit the usefulness of a particular mask material, i.e., prevents the formation of the most desirable spacings for a given application between the hill features of the mask. However, a controlled sample is easily utilized to determine if a particular combination is totally adequate.

If no convenient mask for a given material to be etched is available, it is possible to employ a multiple layer substrate to allow choice of a desired mask. This procedure involves choosing a desired mask material and a second etchable material that it does not substantially wet. The chosen second etchable material should adhere to the material to be etched. The base layer (the material to be etched) is coated with the second etchable material that, in turn, is coated by the mask. The substrate is etched by first etching through the second etchable material and then etching the exposed base layer. For example, to etch tungsten using an aluminum mask, silicon oxide is used as the second etchable material.

Once a mask is formed, for example, by evaporation of the mask material onto the substrate, anisotropic etching is performed, i.e., etching that causes the removal of at least twice as much substrate material in the vertical direction as removed in the horizontal direction during the same time period. In a preferred embodiment, reactive ion etching is utilized to produce the desired anisotropic etching. For example, anisotropic etching of tungsten is attained by reactive ion etching utilizing a $CF_4$ etchant in a reactive ion etching apparatus. (It should be noted that if an intermediate etchable material is employed an etchant suitable for this material should be utilized. If this etchant also etches the base material, no further etchant is required. However, if the initial etchant is not suitable for etching the base material or, if desired, a second etchant that is an anisotropic etchant for the base material is employed.) In such a procedure, a plasma is struck in an etchant atmosphere. This plasma is struck utilizing a power density sufficient to maintain the plasma. Generally, this criterion is satisfied by using a power density in the range of 0.2 to 2.0 Watts/cm$^2$.

The depth of the resulting etch pits is controllable by varying the pressure of the etchant composition, the power density, the temperature of the substrate, and the etch time. The particular combination necessary to produce a desired depth in a given material is determined by using a control sample. Generally, with power densities in the range 0.2 to 2.0 Watts/cm$^2$ etchant composition pressures in the range 1 mTorr to 50 mTorr, temperatures in the range 15 degrees C. to 300 degrees C., and etch times in the range 1 minute to 1 hour are employed to obtain depths in the range 0.05 to 2 $\mu$m. For example, when a substrate having 0.2 mm thick tungsten body and 0.1 $\mu$m thick silicon oxide layer is utilized as a substrate, a total gas pressure in the range 10 to 50 mTorr with an etchant composition of $CF_4$ produces a channel depth in the range 0.05 to 2 $\mu$m after etching for 1 to 50 minutes. At these pressures, a stable plasma is maintainable with a power density in the range 0.2 to 1 Watt/cm$^2$.

The desired depth generally depends on the particular application for which the etch body will be utilized. In the case of an emitter of electromagnetic radiation such as an etched tungsten body, it is generally desirable for the depth of the etch pits to be on the order of the wavelength of light, i.e., be in the range of 0.1 to 2 $\mu$m, preferably 0.2 to 0.8 $\mu$m. Especially for visible light generation, it is desirable that the depth of the etch pits be less than the wavelength of infrared radiation, i.e., less than about 0.8 $\mu$m. In this manner, the amount of visible radiation that is produced is significantly enhanced relative to the production of infrared radiation. For other applications, such as catalysis or electron emission, the depth is not as important. Generally, for such applications the depth is tailored for the specific contemplated use.

The center-to-center spacings between etch pits also influence the efficiency of a light emitter. (Center is defined at the centroid of the surface of the mask hill at the substrate.) The spacings obtained depend on the distance between hill structures of the mask material. Generally, the spacings (center-to-center) between hills is determined by the mask material thickness, the deposition temperature of the substrate, the deposition rate of the mask, and the relative surface mobility of the mask on the substrate. For convenient deposition techniques, e.g., evaporation, useful deposition rates do not allow adequate control. Additionally the substrate is generally chosen to yield a desired property for the final body. The mask is primarily chosen so that the desired relative etch rates of mask to substrate are obtained. (See the detailed discussion below.) The thickness of the mask, (as also discussed below) should be sufficient to yield a desired depth of etching in the substrate. Therefore choice of relative mobilities, mask deposition rates, and mask thicknesses is determined for the most part by considerations other than those relating to the desired spacing of hills in the mask. The substrate temperature employed during mask deposition, therefore, is primarily used to control the spacing. For producing light emitters, center-to-center spacings in the range 0.1 $\mu$m to0.5 $\mu$m are advantageously employed. Such spacings are typically achievable using substrate temperatures during mask formation in the range −200 degrees C. to 800 degrees C., preferably 20 degrees C. to 300 degrees C. A control sample is utilized to determine the temperatures best suited to yield the desired spacing.

The shape of the resulting etched body is also controllable. If etching continues until the mask is entirely removed, a cone-shaped structure is obtained. If etching continues after the mask is removed, the tops of these cones also begin to be removed. The longer the etching continues after the mask has been removed, the more truncated the cone. For applications such as light emission and catalysis, the fact that the cones are somewhat truncated is not particularly significant. However, for applications such as electron emission, the pointed structure is necessary to obtain the most desirable results. In the latter application, therefore, it is generally undesirable to continue etching after the mask is substantially removed, i.e., the etching should not continue so that more than 50 percent of the cone is removed after the depletion of the mask hill. (Not all mask hills are the same size and, thus, not all hills are depleted simultaneously. The 50 percent requirement corresponds to an average figure.) Thus, the mask before etching should be sufficiently thick so that this criterion is satisfied. The desired thickness is easily determined from the relative etch rates of the substrate and mask.

To obtain the desired structures, it is most important that the etchant for the mask and substrate material is appropriately chosen. That is, the relative vertical etch rate of the mask material and the etched body using a given etchant should be chosen so that the desired etch pit depth and structure is obtained. Generally, for the particular cone structures that exhibit the advantageous properties obtainable with the inventive process, the ratio of the vertical etch rate of the body being etched to the vertical etch rate of the mask material should be greater than 1, preferably greater than 3.

The following examples illustrate reaction conditions suitable for the subject invention:

EXAMPLE 1

A commercial grade tungsten foil measuring 0.12 mm thick and 6 mm wide by 7 cm long was cleaned by sequential immersion in acetone and isopropyl alcohol.

The cleaned foil was placed on the substrate holder of an electron beam evaporation apparatus. The apparatus was evacuated to a pressure of about $1\times10^{-7}$ Torr. The sample on the substrate holder was heated to 300 degrees C. A target formed from $SiO_2$ was bombarded by electrons having an energy of 4 keV and a current of about 100 mAmps. Silicon oxide was deposited at a rate of 20 Angstroms per second on the foil which was approximately 15 cm from the target. Deposition was continued until a silicon oxide thickness of 1000 Angstroms was achieved.

The target was then changed to one containing 99.99 percent pure aluminum. The aluminum target was bombarded with electrons having an energy of 4 keV with a beam current of 500 mAmps. This bombardment produced an aluminum deposition rate of 5 Angstroms/sec. The deposition was continued until an average aluminum thickness of about 250 Angstroms was obtained. (Average thickness means that the amount of aluminum used would form a layer 250 Angstroms thick if a continuous uniform film had been formed.)

The etching of the substrate was performed in a parallel plate reactive ion etching apparatus. The substrate was placed on the powered electrode of the apparatus. (The electrodes were parallel, measured 5 inches in diameter and were spaced 2 inches apart.) The apparatus was evacuated to a pressure of less than 0.1 mTorr. An environment of 40 mTorr of $CF_4$ was introduced into the apparatus. A rf power density of 0.5 1 Watts/cm² was used to ignite the plasma. The etching was continued for 7 minutes and then the sample was removed.

The resulting cones produced in the tungsten foil had horizontal dimensions of approximately 0.15 μm and heights of about 0.3 μm.

The etched surface appeared quite black to the unaided eye. The reflectance of the etched tungsten relative to the reflectance of an unetched tungsten sample is shown in the FIGURE. As shown by the FIGURE, through the visible spectrum the reflectance of the etched tungsten was significantly reduced, while at longer wavelengths the reflectance of the etched tungsten approaches that of the untreated material.

EXAMPLE 2

The procedure of Example 1 was followed except a part of the foil was masked so that it was not etched. The foil was resistively heated in a vacuum. The etched area glowed significantly brighter than the unetched area.

EXAMPLE 3

The procedure of Example 1 was followed except the plasma etching was initially done in a 20 mTorr atmosphere of $CHF_3$ at a power density of 0.5 Watts/cm². This etch was continued for 2.5 minutes until the silicon oxide portion of the substrate had been etched through. Then 40 mTorr of $CF_4$ as described in Example 1 was employed for 5 minutes to produce cones in the tungsten having a depth of 0.35 μm and a spacing of 0.3 μm. The resulting body looked quite black.

EXAMPLE 4

The procedure of Example 3 was followed except an environment of 40 mTorr of $CF_3Br$ was employed for 15 minutes instead of the $CF_4$ environment. Additionally, the $CHF_3$ etching was continued for 3 rather than 2.5 minutes. The resulting body also appeared very black.

What is claimed is:

1. A process for producing an article comprising the steps of forming a mask on the surface of a substrate and etching said substrate by anisotropic etching characterized in that said mask is formed by depositing onto said substrate a material that does not substantially wet said surface of said substrate, and wherein said etching produces a ratio of vertical etch rates of said substrate to said mask of greater than 1.

2. The process of claim 1 wherein said ratio is greater than 3.

3. The process of claim 2 wherein said substrate comprises tungsten.

4. The process of claim 1 wherein said substrate comprises tungsten.

5. The process of claim 3 or 4 wherein said etching is performed employing a $CF_4$ environment.

6. The process of claim 1 wherein said substrate comprises a layer of tungsten and a layer of silicon oxide.

7. The process of claim 1 wherein said etching is reactive ion etching.

8. The process of claim 7 wherein said etching is performed in a $CF_4$ environment.

9. The process of claim 7 wherein said etching is performed in a $CF_3Br$ environment.

10. The process of claim 1 wherein said etching is reactive ion etching done sequentially in an environment of $CHF_3$ and $CF_3Br$.

11. The process of claim 1 wherein said etching is reactive ion etching done sequentially in an environment of $CHF_3$ and $CF_4$.

12. The process of either claim 10 or 11 wherein said substrate comprises a layer of tungsten and a layer of silicon oxide.

* * * * *